United States Patent [19]

Stockman et al.

[11] 4,416,044

[45] Nov. 22, 1983

[54] CAST RECUPERATOR TUBE

[75] Inventors: Richard F. Stockman, Friendship; Paul L. Macler, Wellsville, both of N.Y.

[73] Assignee: The Air Preheater Company, Inc., Wellsville, N.Y.

[21] Appl. No.: 246,214

[22] Filed: Apr. 2, 1981

[51] Int. Cl.[3] ..... B23P 15/26

[52] U.S. Cl. ..... 29/157.3 R; 164/137; 164/410; 164/31; 164/32; 164/370; 164/397

[58] Field of Search ..... 164/30, 31, 32, 369, 164/370, 397, 400, 28, 137; 29/527.6, 157.3 R

[56] References Cited

U.S. PATENT DOCUMENTS

| | | | |
|---|---|---|---|
| 1,286,375 | 12/1918 | McLachlan | 29/527.6 X |
| 1,657,444 | 1/1928 | Prince | 164/30 |
| 1,804,400 | 5/1931 | Davis | 164/31 |
| 3,554,271 | 1/1971 | Goss | 164/30 |

*Primary Examiner*—Howard N. Goldberg
*Assistant Examiner*—V. K. Rising
*Attorney, Agent, or Firm*—William W. Habelt; Wayne H. Lang

[57] ABSTRACT

The method of casting a plate type recuperative heat exchange envelope that encloses a hollow space therein in a single casting operation. A sand core with a heat sensitive binder therein defines the hollow space within the envelope. The sand core is supported by end extensions and lateral protuberances which rest on the sides of a sand mold to provide a space therebetween that is subsequently filled with molten metal to comprise an envelope casting. Lateral openings through the envelope casting produced by the lateral protuberances and end openings produced by the end extensions provide passageways for venting gases produced within the sand core during the casting operation, and after completion of the casting operation the same openings in the envelope assist in the removal of the sand core therefrom. The lateral openings are subsequently plugged while the end openings are maintained open to direct the flow of fluid therethrough.

13 Claims, 6 Drawing Figures

CAST RECUPERATOR TUBE

BACKGROUND OF THE INVENTION

This invention relates generally to the method of casting a metallic plate type heat exchanger as is used for the transfer of heat from one gaseous fluid to another.

In certain fields of application wherein corrosive or erosive gases are directed through such heat exchangers, cast iron is considered a preferred constituent inasmuch as cast iron has unique properties that effect resistance to corrosion and erosion from the gases.

Accordingly, U.S. Pat. Nos. 1,992,097, 2,537,276, and U.K. Pat. No. 1,197,409 are directed to various arrangements that utilized cast iron plates held in a spaced relation by a multiplicity of longitudinal bolts. The individual plates of the heat exchanger are first assembled by hand, bolts are inserted through holes in flanges at the sides of the plates, and fastening means such as nuts are then individually placed thereon and secured to provide a completely assembled envelope unit.

Gasket material such as pliable asbestos rope must be placed between envelope plates before they are bolted together to provide a satisfactory seal that precludes leakage of fluid between envelope plates.

Such a manufacturing process is slow and it requires excessive amounts of hand labor to assemble and properly join the separate elements of the heat exchanger into a leakage free unit. Moreover, the holes through abutting plates seriously weaken the plates to require additional reinforcement that adds even more to the cost and weight of the heat exchanger. An improvement in the casting process is disclosed in co-pending application Ser. No. 218,892 filed Dec. 22, 1980, wherein independent recuperator halves are cast separately and bonded together with molten metal along an imperforate peripheral flange that is common to both of the recuperator halves. While such a casting process as disclosed increases the strength of a completed unit and it substantially reduces the manufacturing time, cost and labor required to produce such as unit, the weight remains substantially the same, and the manufacturing process continues to be excessively time consuming and expensive.

SUMMARY OF THE INVENTION

This invention is therefore directed to an improved method of casting a hollow envelope body for a recuperative heat exchanger. The entire envelope is cast as an integral unit in a single casting operation that eliminates excessive casting time and assembly. Moreover, a heretofore necessary flange for connecting opposite sides of the envelope unit is eliminated, thus decreasing the amount of molten metal required and the final weight of a completed envelope. Inasmuch as the envelope is cast integrally, there is no inherent leakage, so the cost of operation is significantly reduced while the active life expectancy and effectiveness are conversely greatly enhanced.

A monolithic block of packed sand having a suitable binder therein is formed in a core box to have the outer configuration of the hollow internal space enclosed within a heat exchange envelope. This is standard practice as outlined in my previous application Ser. No. 218,892 filed on Dec. 22, 1980. The sand that comprises the sand core is mixed with a commercial grade binder that has a controlled rate of disintegration at high casting temperatures whereby said core will partially disintegrate to permit removal thereof after the casting has cooled.

The core is formed as a packed sand body that includes similar end segments with one or more identical but separate center segments therebetween. Protuberances that extend laberally from the sides of each segment of the core are held in depressions formed in the sides of a sand mold having the predetermined outlines of the envelope. When the core is suspended within the mold there is formed a cavity therebetween which is then filled with molten casting metal. Upon cooling, the molten metal solidifies to form an integral heat exchange envelope having continuous end and center sections. Inasmuch as the protuberances extending from the core to the mold produce a void in the finished casting, these openings are accordingly tapped and fitted with a tightly fitting plug that precludes fluid leakage therethrough.

The sand mold is formed in end and center segments having a predetermined capacity much like the formation of the sand core. However, inasmuch as pouring molten metal into the mold creates a fluid pressure having an outward force tending to force the mold apart, abutting mold segments are contained in a strongback or flask designed to have a strength sufficient to withstand the pressure caused by the molten metal.

Inasmuch as the sand core and the sand mold are both made up of abutting modules, the size and capacity of an envelope unit may be readily made to have a predetermined capacity designed to fulfill a particular function.

DESCRIPTION OF THE PREFERRED EMBODIMENT

Figure 1:
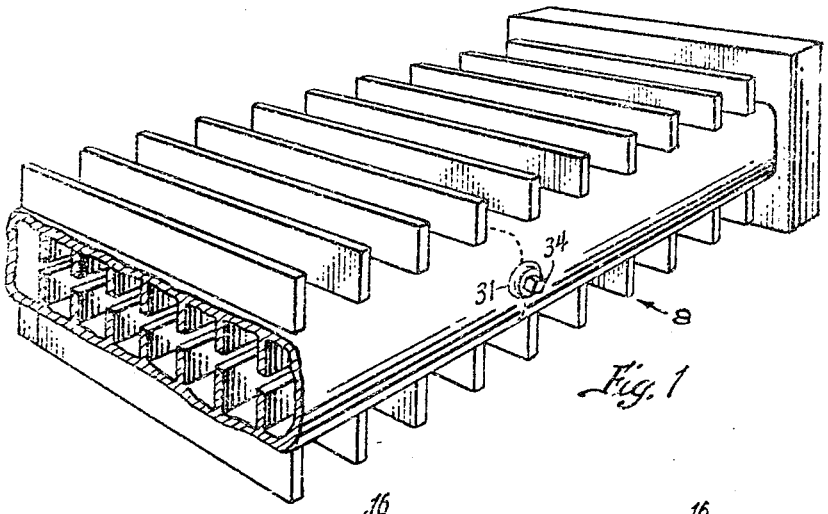
FIG. 1 shows a perspective view of an envelope for a recuperative heat exchanger made according to the present invention.

According to the invention a conventional pattern of wood or metal having an outer configuration corresponding to the outer configuration of the envelope shown in FIG. 1 is first made in accordance with accepted procedures. The pattern for each envelope is made in modular form to include end and center sections whereby an envelope having a predetermined length, surface area and heat exchange capacity may be constructed by adding to or deleting from the number of center sections between similar ends of the heat exchanger. The dividing line between end and center sections is represented by the dotted line that extends through plug 34.

Figure 2:
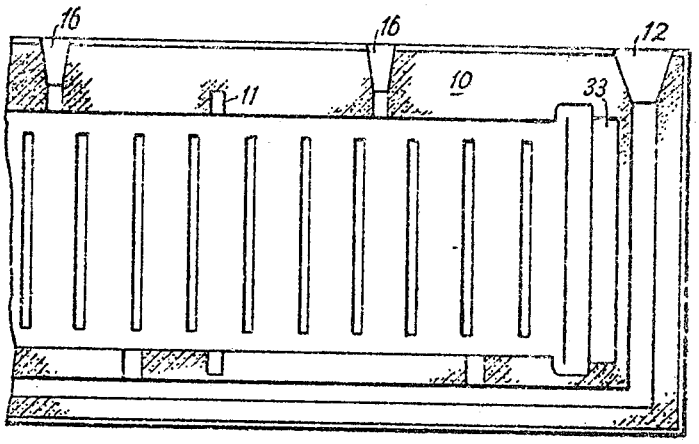
FIG. 2 is a partial plan view of one of the identical halves of a sand mold.
Figure 4:
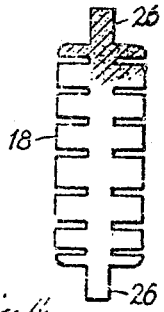
FIG. 4 is a cross-section of the sand core as seen from line 4—4 of FIG. 3.
Figure 3:
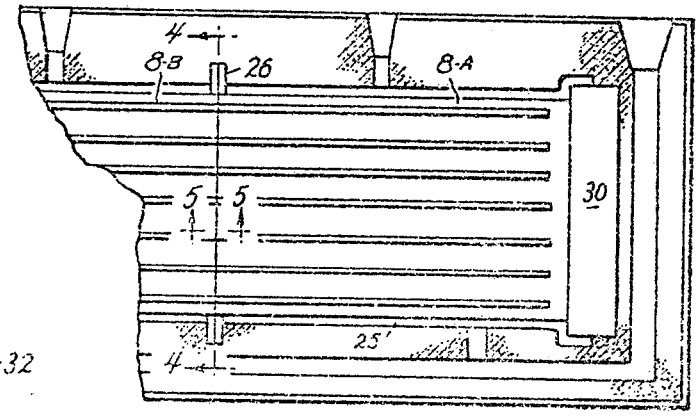
FIG. 3 is a partial plan view of a half of a sand mold containing a sand core therein.

From this pattern, upper and lower portions (cope and drag) of a sand mold 10 are formed. The sand that is used to form the mold is mixed with a standard binder that is adapted to harden upon contact with the ambient air. The mold is formed in the conventional manner, and it includes depressions 11 along the sides thereof that are adapted to support protuberances 26 that extend laterally from the sand core as shown by FIG. 3. The sand mold includes depressions for sprues 12, gates and risers 16 as shown in FIGS. 2 and 3, whereby placing the two mold halves together will form a continuous passageway for the supply of molten metal into the mold.

A sand core 18 is formed to fit loosely inside the mold to provide a clearance space therebetween that, when fille with molten casting metal, becomes the envelope.

Figure 5:
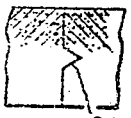
FIG. 5 is a cross-section of the sand core as seen from line 5—5 of FIG. 3.

The sand core 18 has an outer configuration corresponding to the inverse of the inside walls of the envelope. The sand core is formed of end modules 8-A and center modules 8-B that fit in end-to-end abutment to lie in the cavity of the mold to form a clearance space 25 as shown in FIG. 3. Each module of the core has protuberances 26 that extend laterally therefrom to the depressions 11 on the side of the sand mold whereby abutting modules of the sand core 18 are held firmly against shifting so they will at all times be in exact abutment thereby providing a smoothly contoured inner surface of the heat exchanger envelope. Irregularities formed in the end faces of abutting modules as shown in FIG. 5 further preclude shifting of individual modules.

The sand comprising the sand core 18 is mixed with a binder that is adapted to harden at low heat (300° F. to 500° F.), and then break down when exposed to the high temperature of the molten casting metal after it has been poured into the clearance space between the core and the mold. Thus the segments of the sand core remain monolithic sand blocks at lower temperatures, but after the binder has been heated by the high temperature of the molten metal they disintegrate adjacent the molten metal and allow the sand to return to a particulate state. After cooling and solidification of the metal that comprises the envelope, the particulate sand of the core together with the remnants of the core are readily removed from the newly cast envelope.

Sand core segments are preferably made up and stored whereby they may be made available for use at any given time.

The segments of the core are formed with irregularities 20 that mate with other irregularities of an adjacent segment. Thus a male irregularity at one end of a segment matches up with a female irregularity at the end of an adjacent segment to insure direct alignment of one segment with a segment adjacent thereto.

The end 30 of each end segment 8-A of the sand core comprises a solid block that extends past the mold cavity and is supported in a suitable depression 33 at the end of the mold in the manner shown by FIG. 3 whereby a clearance space between the end of the core and the mold defines the open inlet and outlet ends of the envelope casting.

Figure 6:
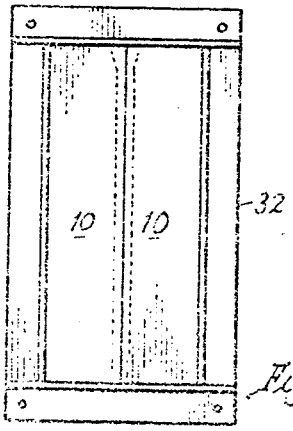
FIG. 6 is an end view that shows upper and lower sections of a sand mold enclosed in a flask or strongback.

Upper and lower halves 10 of the sand mold are enclosed in a flask 32 or strongback that supports the sand mold and permits it to be moved to an upright position as shown in FIG. 6. Accordingly, molten casting metal may be poured into the sprues 12 and gates for entrance into the cavity or clearance space 25 between the core and the mold. As the metal rises in the cavity or clearance space 25, any excess metal, together with impurities and gases, comes to the top of the casting in risers 16 according to standard casting practice, and upon cooling and solidification may be removed to produce a smooth outer surface.

Since the protuberances 26 extend laterally through the cavity 25 in which the heat exchange envelope is to be formed by the molten casting metal, the metallic envelope will have voids or openings 31 where each protuberance 26 occurs. These openings are subsequently tapped to thereby adapt them to receive a threaded plug 34 that precludes fluid flow therethrough. These same openings 31 are instrumental in removal of particulate sand and other core remnants from the envelope after the casting process has been complete, and during the casting process these openings form an escape route for gases produced by the action of hot molten metal upon the binder of the core. These gases may slowly vent through the interstices between grains of sand in the mold, although additional vents may be formed in the mold outward from the depressions 11 to provide a suitable path for gases from the core to escape to the atmosphere.

Although a heat exchange envelope comprised of cast iron inherently has a high resistance to corrosion and erosion, an even greater resistance may be imparted thereto by bonding a ceramic enamel coating to the surface thereof. Accordingly, before the newly cast envelope is permitted to corrode it is preferably subjected to standard enameling procedures.

What is claimed is:

1. A method of casting a hollow metallic envelope having a desired interior surface shape and a desired exterior surface shape comprising the steps of:

a. forming a sand core contoured to provide the desired interior surface shape of the metallic envelope and having integral therewith protuberances extending laterally outward therefrom, said sand core being formed of two end modules and at least one center module adapted to mate in end-to-end abutment;

b. forming independent upper and lower portions of a sand mold which mate to form a cavity adapted to receive the sand core and contoured to provide the desired exterior surface shape of the metallic envelope and having passageways formed therein that include sprues and gates for the pouring of molten metal into the cavity, the upper and lower portions of the sand mold having depressions for receiving the protuberances extending laterally outward from the sand core;

c. placing the sand core into the lower portion of the sand mold with the protuberances extending from the sand core fitted in the depressions in the lower portion of the sand mold whereby the sand core is supported within the cavity of the sand mold so as to form a lower clearance space therebetween;

d. placing the upper portion of the sand mold over the sand core with the depressions therein fitted on the protuberances extending from the sand core thereby abutting the upper portion of the sand mold with the lower portion of the sand mold thereby forming an upper clearance space between the sand mold and the sand core continuous with the lower clearance space therebetween;

e. enclosing the abutting upper and lower portions of the sand mold in a stongback thereby imparting rigidity to the sand mold; and f. pouring a quantity of molten metal into the sprues and gates of the sand mold to supply molten metal into the clearance space that upon cooling solidifies to the hollow metallic envelope.

2. The method of casting a hollow metallic envelope as defined in claim 1 including the step of forming vents in the sand mold extending outwardly from the protuberances of the sand core to permit gases formed by heating of the sand core during the pouring operation to be vented to the atmosphere.

3. The method of casting a hollow metallic envelope as defined in claim 2 including the step of forming the protuberances integral with the sand core at the ends of each independent core module whereby the protuberances of adjacent modules abut and extend laterally as an integral support for the sand core.

4. The method of casting a hollow metallic envelope as defined in claim 3 including the step of forming the protuberances of each independent core module in semicylindrical form having diametric sides that abut while the arcuate sides thereof combine to form a cylindrical support.

5. The method of casting a hollow metalic envelope as defined in claim 4 including the step of forming abutting core modules with oppositely aligned irregularities whereby abutting modules mesh to preclude relative movement between abutting modules.

6. The method of casting a hollow metallic envelope as defined in claim 5 including the step of adding a binder to the sand mold adapted to harden upon contact with the ambient air.

7. The method of casting a hollow metallic envelope as defined in claim 6 that includes adding a binder to the sand core that hardens upon contact with low heat and breaks down upon contact with the high heat of molten casting metal.

8. The method of casting a hollow metallic envelope as defined in claim 7 including the step of heating the molten casting metal to from 1425 C to 1540 C that when poured into the clearance space between the sand core and the sand mold heats the sand core to cause the binder in the outer portion thereof to disintegrate into particulate sand.

9. The method of casting a hollow metallic envelope as defined in claim 8 including the step of cooling the molten casting metal to the ambient temperature and removing particulate sand and the remainder of the sand core from the solidified casting to provide an open ended envelope with openings along the sides thereof formed by the protuberances extending from the sand core.

10. The method of casting a hollow metallic envelope as defined in claim 9 including the step of tapping the openings along the sides of the envelope to thus adapt each opening to receive a threaded plug and screwing a plug into each tapped opening to fully enclose the sides of the envelope.

11. The method of casting a hollow metallic envelope as defined in claim 10 including the step of bonding a ceramic enamel coating to the surface of the envelope to enhance the resistance of said envelope to corrosion and erosion.

12. The method of casting a hollow metallic envelope as defined in claim 1 wherein the step of forming the sand core comprises placing a plurality of center core modules in end-to-end abutment between two spaced end core modules abutting the ends of the abutted center modules to provide an envelope of increased length.

13. The method of casting a hollow metallic envelope as defined in claim 12 further comprising the step of forming abutting core modules with oppositely aligned irregularities whereby abutting modules mesh to preclude relative movement therebetween.

* * * * *